US011583161B2

(12) United States Patent
Shashidhar

(10) Patent No.: US 11,583,161 B2
(45) **Date of Patent: *Feb. 21, 2023**

(54) DISHWASHER AND METHOD OF OPERATION WITH SETTINGS INFLUENCED BY FOOD PREPARATION

(71) Applicant: Whirlpool Corporation, Benton Harbor, MI (US)

(72) Inventor: Sharath Chandra Machenahalli Shashidhar, Turuvekere (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/111,061

(22) Filed: Dec. 3, 2020

(65) Prior Publication Data

US 2021/0085152 A1 Mar. 25, 2021

Related U.S. Application Data

(63) Continuation of application No. 16/141,445, filed on Sep. 25, 2018.

(51) Int. Cl.

| | |
|---|---|
| ***A47L 15/00*** | (2006.01) |
| ***A47L 15/46*** | (2006.01) |
| ***A47L 15/44*** | (2006.01) |

(52) U.S. Cl.

CPC ..... *A47L 15/0021* (2013.01); *A47L 15/449* (2013.01); *A47L 15/46* (2013.01); *A47L 2301/08* (2013.01); *A47L 2501/30* (2013.01)

(58) Field of Classification Search

CPC .. A47L 15/0063; A47L 15/0021; A47L 15/46; A47L 2501/30; A47L 2301/06; A47L 2301/08

See application file for complete search history.

(56) References Cited

U.S. PATENT DOCUMENTS

| | | | |
|---|---|---|---|
| 6,587,739 | B1 | 7/2003 | Abrams et al. |
| 7,069,091 | B2 | 6/2006 | Williamson |
| 8,402,376 | B2 | 3/2013 | Argue et al. |
| 9,743,820 | B2 | 8/2017 | Beaudet et al. |
| 2010/0287709 | A1 | 11/2010 | Doyle et al. |
| 2013/0086520 | A1 | 4/2013 | Beaudet et al. |
| 2014/0180847 | A1 | 6/2014 | Silverstein et al. |
| 2014/0215065 | A1 | 7/2014 | Fisher |
| 2017/0139379 | A1 | 5/2017 | Scheckelhoff |
| 2017/0354305 | A1 | 12/2017 | Beaudet et al. |
| 2018/0131536 | A1 | 5/2018 | McCoy |

FOREIGN PATENT DOCUMENTS

| | | | |
|---|---|---|---|
| CN | 105137780 | A | 12/2015 |
| EP | 2302605 | A | 3/2011 |
| JP | 2004241993 | A | 8/2004 |
| JP | 200643421 | A | 2/2006 |
| JP | 2006204336 | A | 8/2006 |
| JP | 2016165412 | A | 9/2016 |

*Primary Examiner* — Natasha N Campbell

(74) *Attorney, Agent, or Firm* — McGarry Bair PC

(57) ABSTRACT

A dishwasher can be included in a home network and can be utilized to complete a cycle of operation. The dishwasher includes a controller capable of automatically determining treating at least one cycle parameter based on the communication of at least one aspect of a recipe. The at least one aspect of a recipe can be wirelessly provided to a computer system that is in communication with the dishwasher. The computer system can be the controller or any known computer system in communication with the dishwasher.

18 Claims, 6 Drawing Sheets

DISHWASHER AND METHOD OF OPERATION WITH SETTINGS INFLUENCED BY FOOD PREPARATION

CROSS-REFERENCE TO RELATED APPLICATIONS

This application is a continuation of U.S. patent application Ser. No. 16/141,445, filed Sep. 25, 2018, now U.S. Pat. No. 10,881,266, which is incorporated herein by reference in its entirety.

BACKGROUND

Users are increasingly interested in remote communication with household appliances, including dishwashers, in order to efficiently manage usage of the appliance. It is known to provide a household appliance, such as a dishwasher, with a system of devices to facilitate remote communication. This allows a user to remotely control cycle settings to the household appliance from a mobile device.

BRIEF DESCRIPTION

In one aspect, the disclosure relates to a method of operating a dishwasher, the method comprising automatically receiving, at the controller, at least one input from an application on a mobile device, where the at least one input is related to a recipe utilized by the user, determining at least one parameter of a load based on the at least one input, selecting, via the controller, at least one cycle parameter based on the at least one parameter of the load to define a cycle of operation, operating, via the controller, the dishwasher to execute the defined cycle of operation, and obtaining user feedback related to the defined cycle of operation, and repeating or selectively adjusting a future defined cycle of operation based thereon.

DETAILED DESCRIPTION

Figure 1:
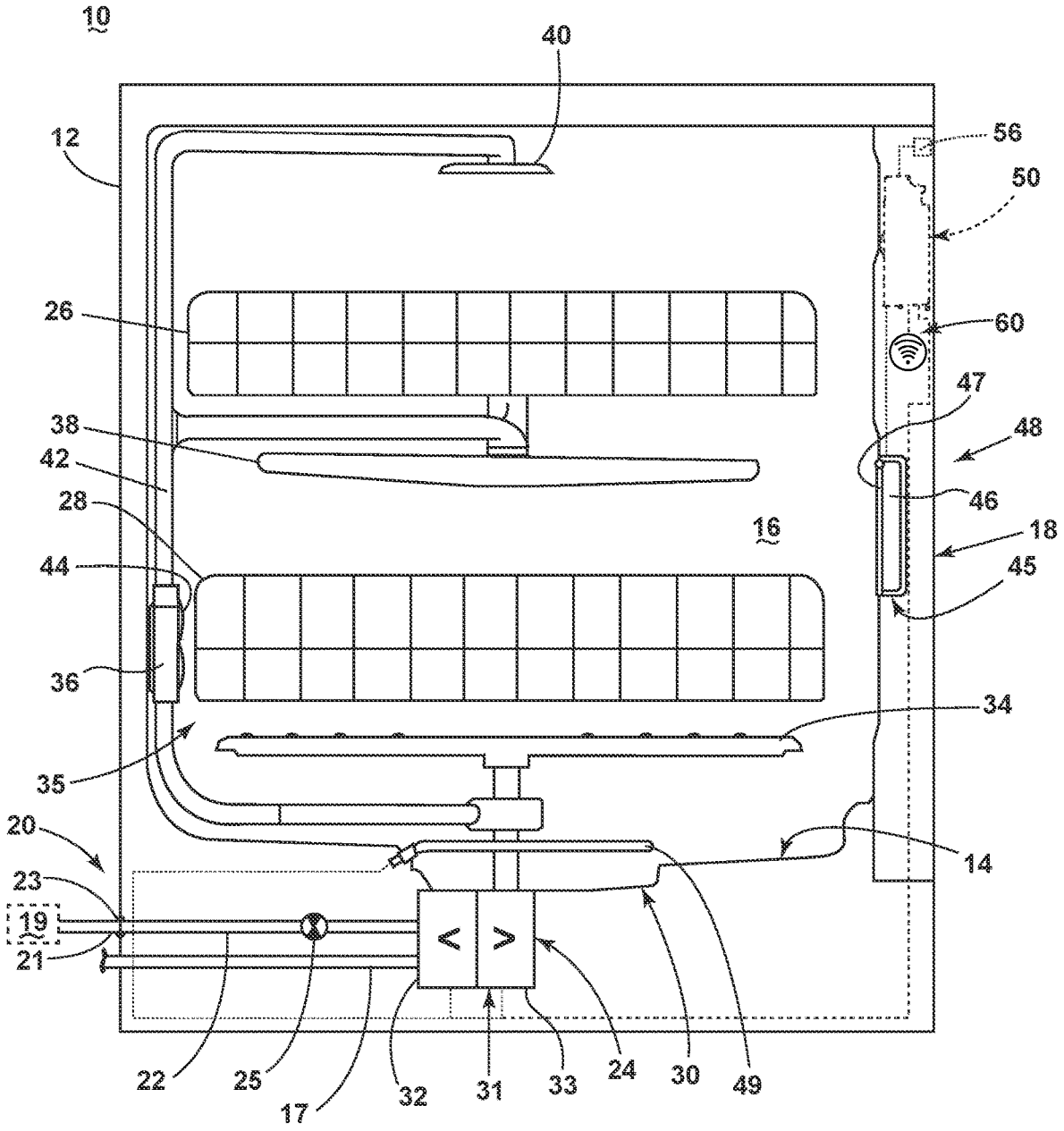
FIG. 1 is a schematic, cross-sectional view of a dishwasher having at least one device to facilitate remote communication.

The aspects of the present disclosure are generally directed toward methods of operating a dishwasher or home network including a dishwasher where at least one cycle parameter of a cycle of operation for the dishwasher can be based on at least one aspect of a recipe or food preparation related thereto communicated to the dishwasher or the home network. The at least one aspect of a recipe or food preparation related thereto can be received or communicated via a mobile phone, tablet, or other known system.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

In FIG. 1, an automated dishwasher 10 according to an aspect of the present disclosure is illustrated. A chassis 12 can define an interior of the dishwasher 10 and can include a frame, with or without panels mounted to the frame. An open-faced tub or tub 14 can be provided within the chassis 12 and can at least partially define a treating chamber 16, having an open face for receiving dishes for treating. A door assembly 18 can be movably mounted to the dishwasher 10 for movement between opened and closed positions to selectively open and close the tub 14. Thus, the door assembly 18 provides accessibility to the treating chamber 16 for the loading and unloading of dishes or other washable items.

It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, user access to the treating chamber 16 can be prevented, whereas user access to the treating chamber 16 can be permitted when the door assembly 18 is open.

Dish holders, illustrated in the form of an upper rack 26 and a lower rack 28 are located within the treating chamber 16 and receive dishes for washing. The upper rack 26 and lower rack 28 are typically mounted for slidable movement in and out of the treating chamber 16 for ease of loading and unloading. Other dish holders can be provided, such as a silverware basket. As used in this description, the term "dish(es)" is intended to be generic to any item, single or plural, that can be treated in the dishwasher 10, including, without limitation, dishes, plates, pots, bowls, pans, glassware, and silverware.

A spray system 35 is provided for spraying liquid in the treating chamber 16 and can include, but is not limited to, a spray system assembly 34, a lower spray assembly 36, a rotating mid-level spray assembly 38, and/or an upper spray assembly 40. Upper spray assembly 40, mid-level spray assembly 38, and spray system assembly 34 are located, respectively, above the upper rack 26, beneath the upper rack 26, and beneath the lower rack 28 and are illustrated as rotating spray arms. The lower spray assembly 36 is illustrated as being located adjacent the lower rack 28 toward the rear of the treating chamber 16. The lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system 24 is provided for recirculating liquid from the treating chamber 16 to the spray system. The recirculation system 24 can include a sump 30 and a pump assembly 31. The sump 30 collects the liquid sprayed in the treating chamber 16 and can be formed by a sloped or recess portion of a bottom wall of the tub 14. The pump assembly 31 can include both a drain pump 32 and one or more recirculation pumps 33. The drain pump 32 can draw liquid from the sump 30 and pump the liquid out of the dishwasher 10 to a household drain line 17. The recirculation pump 33 can draw liquid from the sump 30 and the liquid can be simultaneously or selectively pumped through a supply tube 42 to one or more of the spray system assembly 34, the lower spray assembly 36, the rotating mid-level spray assembly 38, or the upper spray assembly 40 for selective spraying.

A liquid supply system 20 can be fluidly coupled to the recirculation system 24. The liquid supply system 20 can also be fluidly coupled with a water supply line 21 for receiving fresh water from a water supply source, such as, by way of non-limiting example, a household water supply 19. The liquid supply system 20 can include an inlet fitting 23, which is carried by the chassis 12, a conduit 22 that fluidly couples the inlet fitting 23 to the tub 14, and an actuatable valve 25. The actuatable valve 25 selectively controls the flow of liquid through the conduit 22, allowing the flow of liquid from the conduit 22 into the tub 14 when the actuatable valve 25 is in an opened position, and preventing the flow of liquid from the conduit 22 into the tub 14 when the actuatable valve 25 is in a closed position.

A treating chemistry dispensing system 48 can include a treating chemistry reservoir, a pump for supplying treating chemistry, a valve for selectively opening or closing a treating chemistry supply path, one or more conduits defining a treating chemistry supply path, or any combination thereof. Some non-limiting examples of treating chemistry reservoirs include a bulk dispensing cartridge, a dispensing cup, and a dispensing drawer. A user-accessible dispensing system can be provided for storing and dispensing one or more treating chemistries to the treating chamber 16. As shown herein, the user-accessible dispensing system can include a dispenser 45 mounted on an inside surface of the door assembly 18 such that the dispenser 45 is disposed in the treating chamber 16 when the door assembly 18 is in the closed position. The dispenser 45 is configured to dispense treating chemistry to the dishes within the treating chamber 16. The dispenser 45 can have one or more compartments 46 closed by a dispenser door 47 on the inner surface of the door assembly 18. The dispenser 45 can be a single use dispenser which holds a single dose of treating chemistry, a bulk dispenser which holds a bulk supply of treating chemistry and which is adapted to dispense a dose of treating chemistry from the bulk supply during a cycle of operation, or a combination of both a single use and bulk dispenser.

The dispenser 45 can further be configured to hold multiple different treating chemistries. For example, the dispenser 45 can have multiple compartments defining different chambers in which treating chemistries can be held. While shown as being disposed on the door assembly 18, other locations of the dispenser 45 are possible. However, the dispenser 45 is positioned to be accessed by the user for refilling of the dispenser 45, whether it is necessary to refill the dispenser 45 before each cycle (i.e. for a single user dispenser) or only periodically (i.e. for a bulk dispenser).

A heating system including a heating element 49 can be located within the sump 30 for heating the liquid contained in the sump 30.

A controller 50 can also be included in the dishwasher 10. The controller 50 can be operably coupled with various components of the dishwasher 10 to implement a cycle of operation. By way of non-limiting example, the controller 50 can be operably coupled to the liquid supply system 20, the spray system 35, recirculation system 24, and treating chemistry dispensing system 48 for controlling operation thereof.

The controller 50 can be located within the door assembly 18 as illustrated, or it can alternatively be located somewhere within the chassis 12. The controller 50 can also be operably coupled with a control panel or user interface 56 for receiving user-selected inputs and communicating information to the user. The user interface 56 can include operational controls such as dials, lights, switches, and displays enabling a user to input commands, such as a cycle of operation, to the controller 50 and receive information.

An appliance communication module or wireless communication module 60 can also be operably or communicatively coupled with the controller 50. The wireless communication module 60 is illustrated, by way of non-limiting example, near the controller 50 although this need not be the case as it is contemplated that the wireless communication module 60 can be located anywhere within the dishwasher 10. Further, it is also contemplated that the wireless communication module 60 can be a combination of communication elements located in a variety of locations near or within the dishwasher 10.

Figure 2:
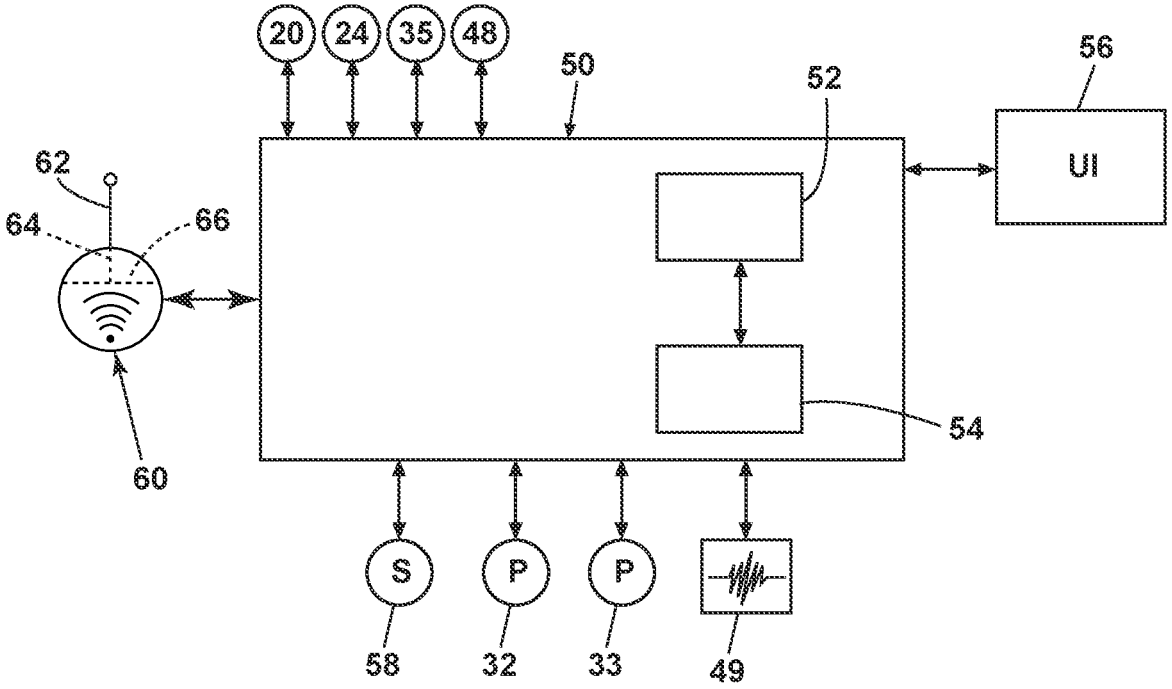
FIG. 2 is a schematic view of a controller of the dishwasher of FIG. 1.

As illustrated schematically in FIG. 2, the controller 50 can be coupled with the heating element 49 for heating the wash liquid during a cycle of operation, the drain pump 32 for draining liquid from the treating chamber 16, and the recirculation pump 33 for recirculating the wash liquid during the cycle of operation. Memory 52 and a central processing unit (CPU) 54 can be provided in the controller 50. The memory 52 can be used for storing control software that can be executed by the CPU 54 in completing a cycle of operation using the dishwasher 10 and any additional software. For example, the memory 52 can store one or more pre-programmed cycles of operation that can be selected by a user and completed by the dishwasher 10.

One or more sensors 58 can also provide input to the controller 50. Non-limiting examples of sensors 58 that can be communicably coupled with the controller 50 include a temperature sensor, humidity sensor, and turbidity sensor to determine the soil load associated with a selected grouping of dishes, such as the dishes associated with a particular area of the treating chamber 16. Additional non-limiting examples of the one or more sensor can be an optical or a weight sensor to provide an input related to a loading position of the dishes. The input related to loading position of the dishes can, by way of non-limiting example, indicate a light load, a medium load, or an irregular loading pattern by user 88.

The wireless communication module 60 coupled to the controller 50 can include, but is not limited to, an antenna 62, a transmitter 64 and a receiver 66. It is contemplated that the wireless communication module 60 can be any variety of communication mechanism capable of wirelessly linking with other systems and devices and can include, but is not limited to Wireless Fidelity (WiFi), WiMax, 3G wireless signal, 4G wireless signal, or any combinations thereof. It will also be understood that later-developed wireless networks are certainly contemplated as within the scope of this disclosure.

The antenna 62 can be used to detect or transmit signals to or from the controller 50. The antenna 62 is operably coupled with the receiver 66 and the transmitter 64. The receiver 66 interprets signals as input communicated to the controller 50. The transmitter 64 outputs information from the controller 50.

Figure 3:
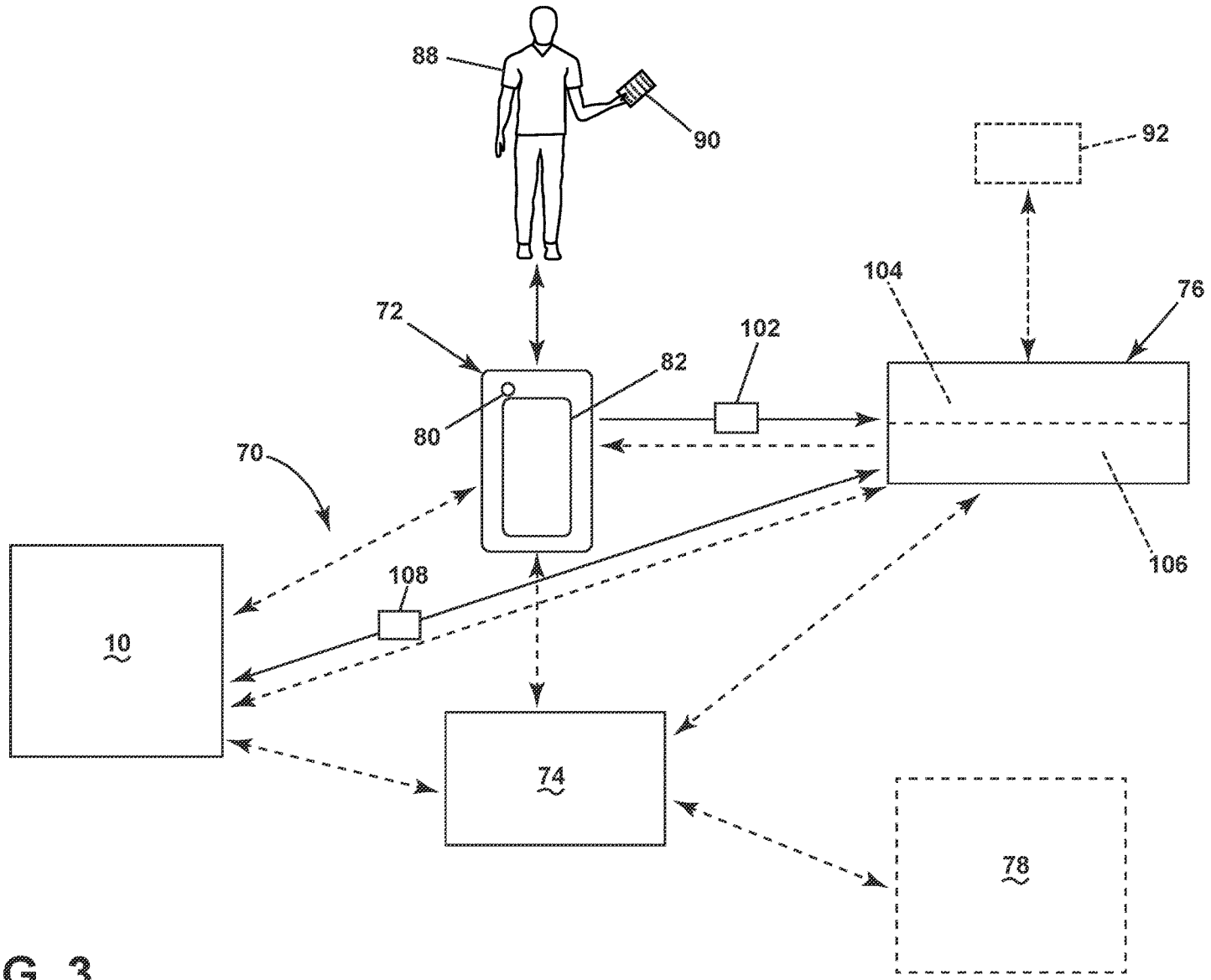
FIG. 3 is a schematic view of a network for exchanging information between at least a user, mobile device, a selection system, and the dishwasher of FIG. 1.

FIG. 3 illustrates a network 70 according to one aspect of the disclosure. The network 70 can include wired, wireless, or a combination of wired and wireless points or nodes to connect communication paths for exchanging and transporting data. The network 70 can also include one or more networks in communication with each other. The network 70 can also include servers and databases (not shown) that can be in communication over a communications network, such as a middleware or cloud storage. The network 70 can include the dishwasher 10, a mobile device 72, a router 74, and a cycle selection module 76. Additionally, the network 70 can include an oven 78. The mobile device 72 can be capable of communicating with the network 70.

The mobile device 72 can send and receive messages and data, including text, short message service (SMS), multimedia messaging service (MMS), or other types of messages, and also transmit or receive data in a form that can be translated and displayed as a message. An imaging device 80 can be included in the mobile device 72 and the imaging device 80 can include a camera, an optical scanner, or a near-field-communication (NFC) reader in non-limiting examples, and can be capable of scanning a barcode or capturing an image in order to read an indicia. An interactive display 82, which can provide users with access and control of the mobile device 72 is also typically included. While the mobile device 72 is illustrated and generally described in relation to a mobile phone, it can, for example, comprise a smartphone, a tablet computer, a desktop computer, or a notebook computer. The mobile device 72 can allow a user 88 to supply input data to the network 70 using the mobile device 72. The input data can be, but is not limited to, data related to a recipe 90 or preparation of foodstuff.

A router 74 is typically used in a home environment, and can provide wired or wireless communication between the dishwasher 10, the mobile device 72, and the cycle selection module 76. Optionally, the router 74 can also communicate with the oven 78. The router 74 can exchange data and information from the mobile device 72 or oven 78 with the cycle selection module 76, and exchange information with the dishwasher 10 as needed. Therefore, the dishwasher 10, mobile device 72, and the cycle selection module 76 can all be in communication with each other through the network 70. Alternatively, the mobile device 72 can communicate directly with the cycle selection module 76.

While the cycle selection module 76 is illustrated as a box in FIG. 3, it is understood that the cycle selection module 76 can be included in part or in whole within the mobile device 72, the dishwasher 10, the oven 78, or an external computer system 92. The cycle selection module 76 can include any suitable processor, suitable programs, neural network, or executable instructions designed to carry out various methods, functionality, processing tasks, calculations, or the like, to enable or achieve the technical operations or operations described herein. The program can include a computer program product that can include machine-readable media for carrying or having machine-executable instructions or data structures stored thereon. Such machine-readable media can be any available media, which can be accessed by a general purpose or special purpose computer or other machine with a processor. Generally, such a computer program can include routines, programs, objects, components, data structures, algorithms, etc., that have the technical effect of performing particular tasks or implement particular abstract data types.

At least one input 102 can be received by the cycle selection module 76. The at least one input 102 can include, but is not limited to, input related to the recipe 90 utilized by the user 88.

As illustrated by way of non-limiting example, the at least one input 102 can be communicated from the mobile device 72 to the cycle selection module 76. Additionally or alternatively, the oven 78, the dishwasher 10, the external computer system 92, cloud storage, or other member of the network 70 can communicate the at least one input 102 to the cycle selection module 76.

The cycle selection module 76, by way of non-limiting example, can be one or more software programs, executable instructions, neural network(s), or combination therein. The cycle selection module 76 receives the at least one input 102 to determine at least one parameter of a load 104. At least one cycle parameter 106 can be selected based on the at least one parameter for the load 104. The at least one cycle parameter 106 define a cycle of operation. The cycle of operation can be communicated as an output 108 from the cycle selection module 76. The output 108 can be received by the controller 50 of the dishwasher 10. Additionally or alternatively, the output 108 can be received by the oven 78, the mobile device 72, the external computer system 92, cloud storage, or other member of the network 70.

Figure 4:
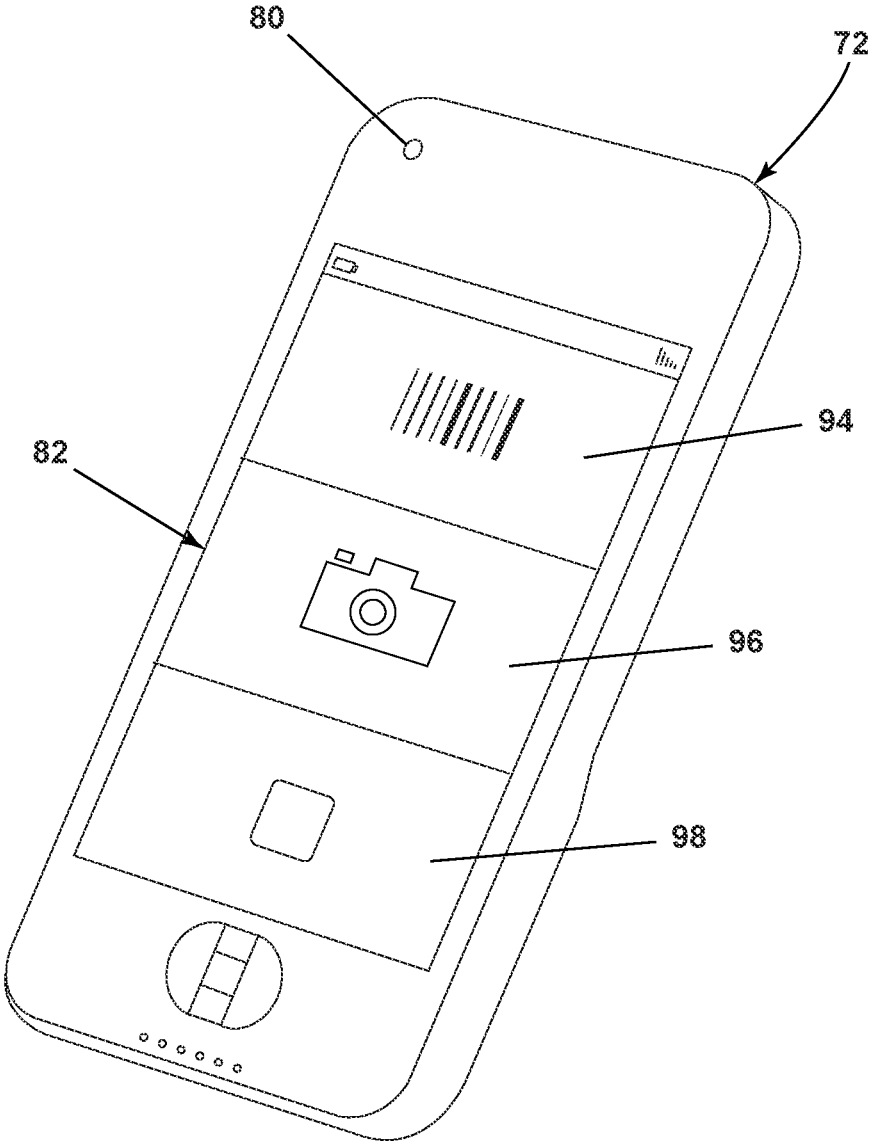
FIG. 4 is a schematic view of a mobile interactive display illustrating input options that can be utilized in the network of FIG. 3.

FIG. 4 is a schematic view of the mobile device 72 with the interactive display 82 illustrating, by way of non-limiting examples, a barcode input 94, a camera input 96, or an application 98. The mobile device 72 can obtain the at least one input 102 (FIG. 3), such as a recipe selection, via the barcode input 94, the camera input 96, the application 98, or other recipe databases connected to the mobile device 72. The user 88 can select a form of input by choosing the barcode input 94, the camera input 96, or the application 98. Optionally, the mobile device 72 can offer any number of additional input forms. An "application," as used herein, can include an application programing interface (API) for interacting with the application or a user, and can enable accessing a communications network in which digital data can be stored or retrieved. The application can use a processor or controller module to operate, execute, or otherwise "run" the application and communicate with the network 70. Additionally, the application can use a user interface, such as the interactive display 82, to allow for user input in order for a user to manipulate the application.

The barcode input 94 can be used to obtain input information related to the recipe 90. The barcode input 94 allows the mobile device 72 to function as a barcode scanner. The mobile device 72 can obtain barcode information through numerical input or using the imaging device 80. By way of non-limiting example, the barcode input 94 can obtain information related to ingredients from a barcode located on ingredient packaging. Additionally or alternatively, the barcode input 94 can be used to upload the recipe 90 in its entirety by identifying a cookbook via a cookbook barcode and page number. It is further contemplated that recipe information can be received via the mobile device 72 using an international standard book number (ISBN) and page number of a recipe book.

The camera input 96 can be used in addition to or in place of the barcode input 94 to obtain input information related to the recipe 90. The camera input 96 allows the mobile device 72 to transfer information from an image to input information related to the recipe 90. The image used by the camera input 96 can be obtained, by way of non-limiting example, using the imaging device 80, receiving a text message, receiving an e-mail, or through downloading from another application or location on the internet.

The application 98 can be used in addition to or in place of the barcode input 94 or the camera input 96 to obtain input information related to the recipe 90. The application 98 can be, but is not limited to, a recipe application or a cooking application where the recipe 90 can be input or recalled. Optionally, the recipe 90 can be selected from a recipe database that can be stored on the external computer system 92. The recipe database can be searchable by at least one user 88 via the mobile device 72.

Figure 5:
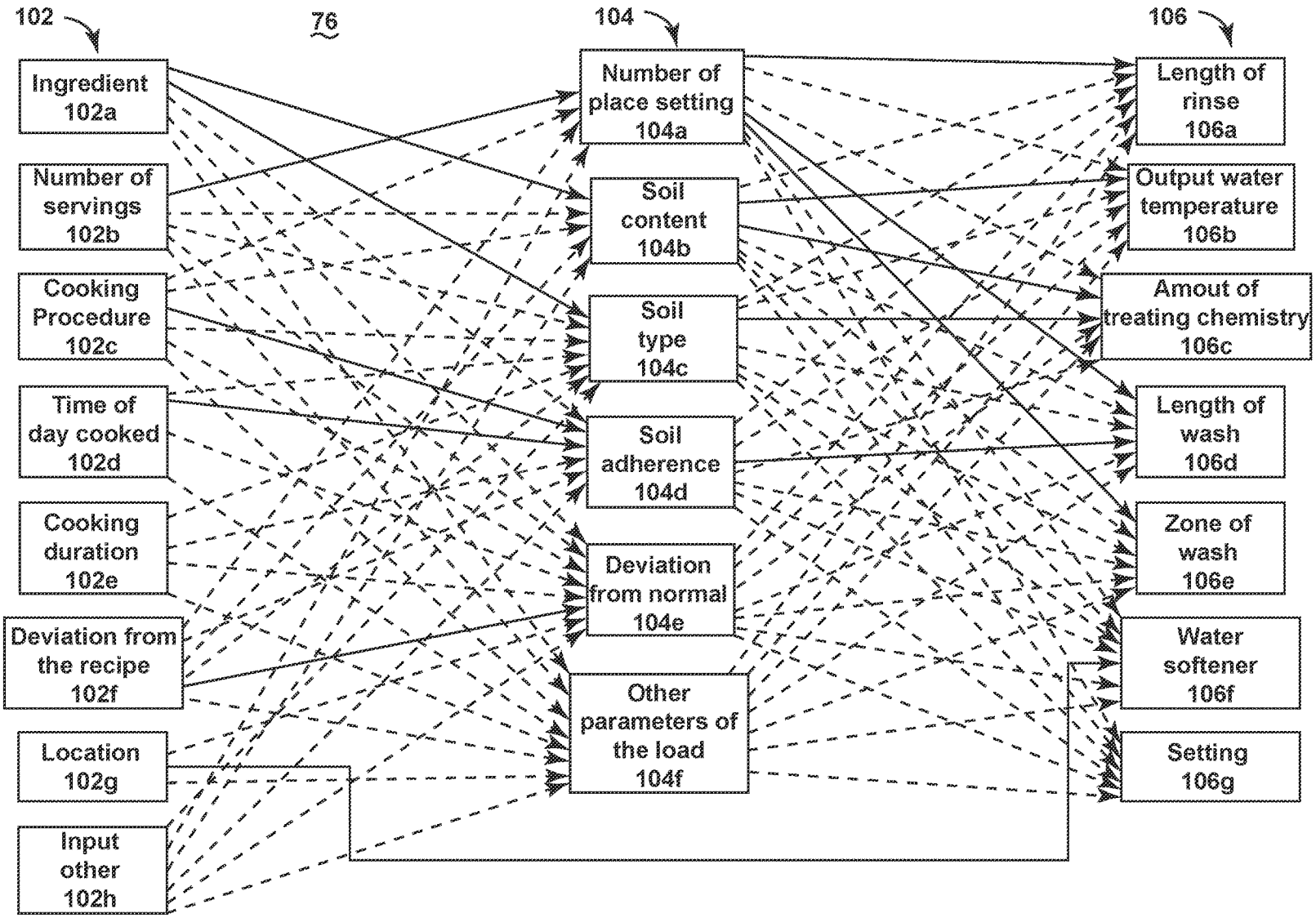
FIG. 5 is a schematic diagram illustrating a selection of at least one cycle parameter based on at least one input, according to one aspect of the disclosure.

FIG. 5 is a schematic view of cycle selection module 76 illustrating, according to one aspect of the disclosure, exemplary relationships that can be used by the cycle selection module 76. The cycle selection module 76 can receive at least one input 102

The at least one input 102 can include, but is not limited to, an ingredient 102*a*, a number of servings 102*b*, cooking procedure 102*c*, time of day cooked 102*d*, cooking duration 102*e*, deviations from the recipe 102*f*, or location 102*g*. Additionally, the at least one input 102 can include other inputs 102*h*.

The ingredient 102*a*, the number of servings 102*b*, the cooking procedure 102*c*, or the cooking duration 102*e* can be interpreted from the recipe 90 and transferred to cycle selection module 76 by the user 88 via the mobile device 72. The mobile device 72 can also provide the cycle selection module 76 with the time of day cooked 102*d* or deviations from the recipe 102*f*. Alternatively, the oven 78 can provide the cycle selection module 76 with the time of day cooked 102*d* or the cooking duration 102*e*. By way of non-limiting example, the location 102*g* can be provided to the cycle selection module 76 by the user 88 via the user interface 56 of the dishwasher 10 or the mobile device 72.

Optionally, other input 102*h* can be provided to the cycle selection module 76. A non-limiting example of other input 102*h* can include input from an optical component or sensors in the oven 78, the one or more sensors 58, or the mobile device 72.

The location 102*g* can be regional water features based on geographic location that can include, but are not limited to, water temperature, water pH, or water hardness of household water supply 19.

The at least one parameter of the load 104 is determined by or based on the at least one input 102. The at least one parameter of the load 104 can include a number of place settings 104*a*, soil content 104*b*, soil type 104*c*, soil adherence 104*d*, or deviations from a normal load 104*e*. Optionally, the at least one parameter of the load 104 can include other parameters of the load 104*f*. The number of place settings 104*a* can be determined by the number of servings 102*b*. Optionally, the number of place settings 104*a* can be determined by the cooking procedure 102*c*, the deviations from the recipe 102*f* or the other input 102*h* in addition to or as an alternative to the number of servings 102*b*.

The soil content 104*b* can be determined by the ingredient 102*a*. Optionally, the number of servings 102*b*, the cooking procedure 102*c*, the deviations from the recipe 102*f* or the other input 102*h* can be used to determine the soil content 104*b* in addition to or as an alternative to the ingredient 102*a*.

The soil type 104*c* can be determined by the ingredient 102*a*. Optionally, in addition to or as an alternative to the ingredient 102*a*, the soil type 104*c* can be determined using the number of servings 102*b*, the cooking procedure 102*c*, the time of day cooked 102*d*, the cooking duration 102*e*, the deviations from the recipe 102*f*, or the other input 102*h*.

The soil adherence 104*d* can be determined by the cooking procedure 102*c* and the time of day cooked 102*d*. Optionally, the ingredient 102*a*, cooking duration 102*e*, the deviations from the recipe 102*f*, or the other input 102*h* can be used to determine the soil adherence 104*d* in addition to or as an alternative to the cooking procedure 102*c* and the time of day cooked 102*d*.

The deviations from a normal load 104*e* can be determined by the deviations from the recipe 102*f*. Optionally, the ingredient 102*a*, the number of servings 102*b*, the cooking procedure 102*c*, the time of day cooked 102*d*, the cooking duration 102*e*, the location 102*g* or the other input 102*h* can be used to determine the deviations from a normal load 104*e* in addition to or as an alternative to the deviations from the recipe 102*f*.

The other parameters of the load 104*f* can be determined by any combination of the at least one input 102.

The cycle selection module 76 can select the at least one cycle parameter 106 based on the at least one parameter of the load 104 that can define a cycle of operation. The defined cycle of operation can be communicated to the controller 50 as illustrated in FIG. 3. The controller 50 of the dishwasher 10 can then operate the liquid supply system 20, spray system 35, recirculation system 24, or treating chemistry dispensing system 48 to implement the defined cycle of operation.

More specifically, the at least one cycle parameter 106 have been exemplary illustrated as including a length of rinse 106*a*, output water temperature 106*b*, amount of treating chemistry 106*c*, length of wash 106*d*, zone of wash 106*e*, or a water softener 106*f*. Optionally, the at least one cycle parameter 106 can include an other cycle parameter 106*g*.

The length of rinse 106*a* can be directly related to the number of place settings 104*a*. Optionally, the length of rinse 106*a* can be affected, based on the soil content 104*b*, the soil type 104*c*, the soil adherence 104*d*, the deviations from a normal load 104*e*, or the other parameters of the load 104*f* in addition to or as an alternative to the number of place settings 104*a*.

The output water temperature 106*b* can be directly related to the soil content 104*b*. Optionally, the output water temperature 106*b* can be affected, based on the location 102*g*. It is further contemplated that the output water temperature 106*b* can be affected, based on the number of place settings 104*a*, the soil type 104*c*, the soil adherence 104*d*, the deviations from a normal load 104*e*, or the other parameters of the load 104*f* in addition to or as an alternative to the soil content 104*b*.

The amount of treating chemistry 106*c* can be directly related to the soil content 104*b* and the soil type 104*c*. Optionally, the amount of treating chemistry 106*c* can be affected, based on the number of place settings 104*a*, the soil adherence 104*d*, the deviations from a normal load 104*e*, or the other parameters of the load 104*f* in addition to or as an alternative to the soil content 104*b* and the soil type 104*c*.

The length of wash 106*d* can be directly related to the soil adherence 104*d* and the number of place settings 104*a*. Optionally, the length of wash 106*d* can be affected, based on the soil content 104*b*, the soil type 104*c*, the deviations from a normal load 104*e*, or the other parameters of the load

104*f* in addition to or as an alternative to the soil adherence 104*d* and the number of place settings 104*a*.

The zone of wash 106*e* can be directly related to the number of place settings 104*a*. Optionally, the zone of wash 106*e* can be affected, based on the soil content 104*b*, the soil type 104*c*, the soil adherence 104*d*, the deviations from a normal load 104*e*, or the other parameters of the load 104*f* in addition to or as an alternative to the number of place settings 104*a*.

The water softener 106*f* can be directly related to or determined by the location 102*g*. Optionally, the water softener 106*f* can be affected, based on the number of place settings 104*a*, the soil content 104*b*, the soil type 104*c*, the soil adherence 104*d*, the deviations from a normal load 104*e*, or the other parameters of the load 104*f* in addition to or as an alternative to the location 102*g*.

The other cycle parameter 106*g* can be affected, based on any combination of the at least one parameter of the load 104 or the at least one input 102. The other cycle parameter 106*g* can include, by way of non-limiting example, spray pressure or pump power input.

Figure 6:
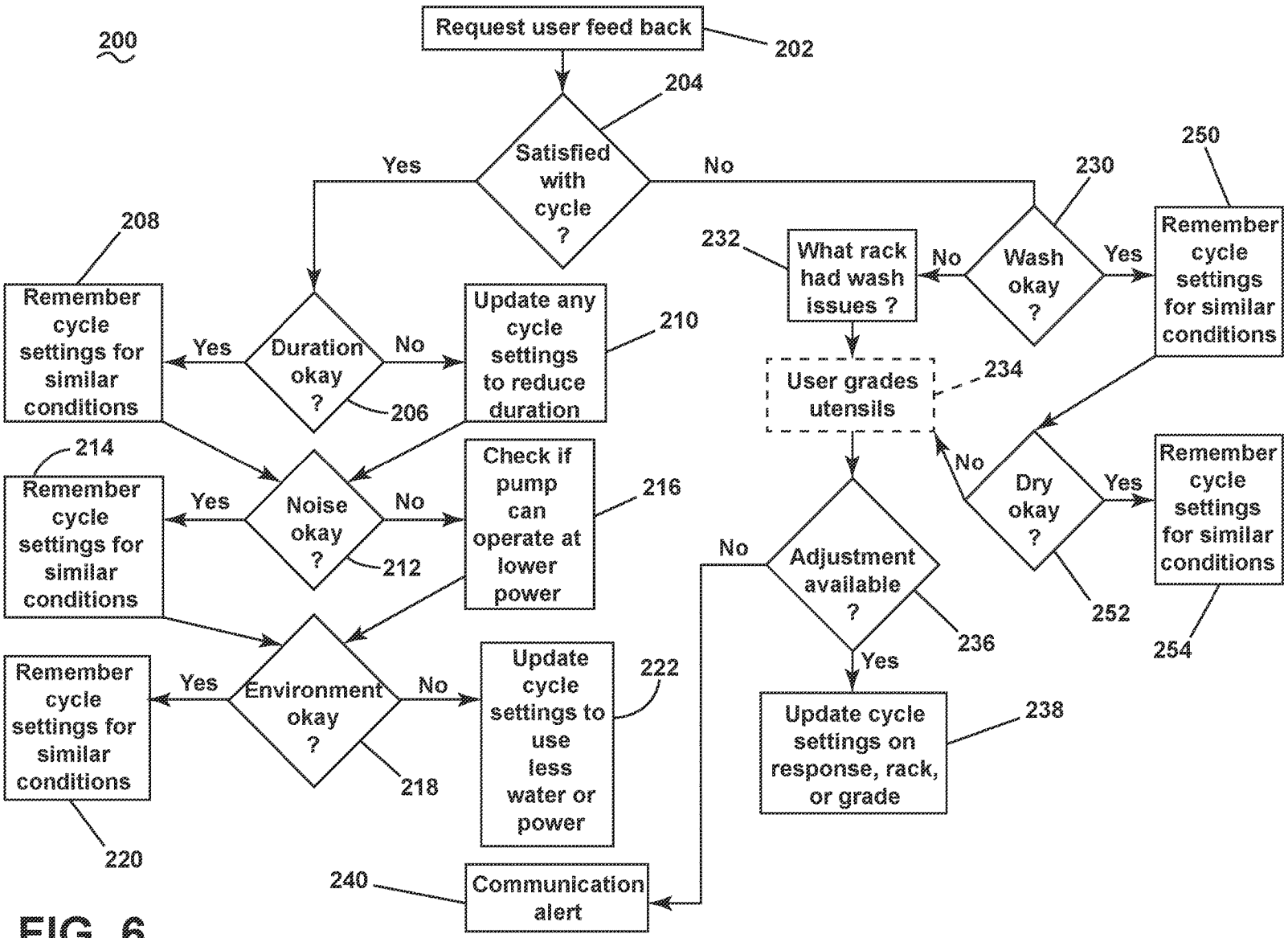
FIG. 6 is a flowchart diagram illustrating a method for obtaining user feedback.

FIG. 6 illustrates, by way of non-limiting example a method 200 for obtaining user feedback on the cycle of operation, after it is executed, from the user 88 according to aspects of the disclosure. Based on the method 200 for obtaining user feedback, the cycle of operation can be remembered and repeated in a future cycle of operation or the cycle can be remembered and adjusted for a future cycle of operation. Additionally or alternatively, the method 200 can trigger a communication alert to the user 88 or the external computer system 92.

The method 200 includes a request user feedback at 202. The user feedback can be requested, by way of non-limiting examples, via the mobile device 72 or the user interface 56. At 204 the user 88 is prompted to provide feedback based on overall satisfaction with the executed cycle of operation defined by the at least one cycle parameter 106. If the user feedback is "yes" at 204, the user is then prompted at 206 to provide feedback based on satisfaction with the duration of the executed cycle of operation. If the user feedback at 206 is "yes," indicating satisfaction with the duration of the cycle of operation, the at least one cycle parameter 106 are remembered at 208 for future use in similar conditions.

If the user feedback at 206 is "no," indicating the user was unsatisfied with the duration of the executed cycle of operation, then at 210, the at least one cycle parameter 106 can be updated to reduce duration; if possible. For example, at 210, the output water temperature 106*b* can be increased for future cycles with similar conditions. The warmer output water temperature can assist in removing soil from dishes. Additionally or alternatively at 210, the amount of treating chemistry 106*c* can be increased. Additional treating chemistry can provide an increase in suds to remove soil from dishes. It is further contemplated that the other cycle parameter 106*g* can be affected at 210, based on user feedback at 206, such as, but not limited to, an increase is spray pressure.

Following 208 or 210, the user is then prompted at 212 to provide feedback based on satisfaction with the level of noise during the executed cycle of operation. If the user feedback at 212 is "yes," indicating satisfaction with the level of noise during the cycle of operation, the at least one cycle parameter 106 are remembered at 214 for future use in similar conditions.

If the user feedback at 212 is "no," indicating the user was unsatisfied with the level of noise during the executed cycle of operation, then at 216, the at least one cycle parameter 106 are updated to reduce noise; if possible. As illustrated at 216, by way of non-limiting example, the at least one cycle parameter 106 can be updated or reviewed to assess if one or more components of the pump assembly 31 can operate at a lower power.

Following 214 or 216, the user is then prompted at 218 to provide feedback based on satisfaction with the environmental aspect of the executed cycle of operation. If the user feedback at 218 is "yes," indicating satisfaction with the economical usage of energy or water during the cycle of operation, the at least one cycle parameter 106 are remembered at 220 for future use in similar conditions.

If the user feedback at 218 is "no," indicating the user was unsatisfied with the level of energy or water consumed during the executed cycle of operation, then at 222, the at least one cycle parameter 106 are updated to reduce consumption of energy or water; if possible. As illustrated at 222, by way of non-limiting example, the at least one cycle parameter 106 can be updated to use less water or energy.

If the user feedback is "no" at 204, the user is then prompted at 230 to provide feedback based a washing portion of the executed cycle of operation. If the user feedback is "no" at 230, the user is then prompted at 232 to provide feedback indicating whether the upper rack 26 or the lower rack 28 was washed at an unsatisfactory level. Optionally, at 234, the user is asked to grade the utensils based on a predetermined scale. At 236, the at least one cycle parameter 106 is reviewed for possible adjustment. If at 236, the decision is "yes," then at 238, the at least one cycle parameter 106 are updated based on the rack input at 232 or the utensil grade at 234.

If at 236, the decision is "no," then at 240 a communication alert is provided. The communication alert at 240 can be, by way of non-limiting example, an indication to the user 88 via the mobile device 72 that the at least one cycle parameter 106 cannot be further updated. Additionally or alternatively, the communication alert at 240 can be, by way of non-limiting example, an automatic communication with the external computer system 92 indicating a possible servicing need for the dishwasher 10.

If the user feedback at 230 is "yes," indicating satisfaction with the washing portion of the executed cycle of operation, the at least one cycle parameter 106 is remembered at 250 for future use in similar conditions. Following 250, the user 88 is prompted at 252 to provide feedback based on satisfaction with the drying portion of the executed cycle of operation. If the user feedback at 252 is "yes," indicating satisfaction with the drying portion of the cycle of operation, the at least one cycle parameter 106 is remembered at 254 for future use in similar conditions.

If the user feedback at 252 is "no," indicating the user was unsatisfied with the drying portion of the executed cycle of operation, then optionally at 234, the user 88 can be prompted to grade the utensils. At 236, the at least one cycle parameter 106 is reviewed for possible adjustment. If at 236, the decision is "yes," then at 238, the at least one cycle parameter 106 is updated based on the user feedback at 252 or the utensil grade at 234.

If at 236, the decision is "no," then at 240 a communication alert is provided. The communication alert at 240 can be, by way of non-limiting example, an indication to the user 88 via the mobile device 72 that the at least one cycle parameter 106 cannot be further updated. Additionally or alternatively, the communication alert at 240 can be, by way of non-limiting example, an automatic communication with the external computer system 92 indicating a possible servicing need for the dishwasher 10.

Benefits of the present disclosure include selecting at least one cycle parameter to build a cycle of operation based on a recipe or preparation of foodstuff. This can include optimization of the parameters of a treating cycle without user input. Additional benefits are achieved by the use of the neural network and user feedback to provide improvement in dishwashing performance.

In operation, by way of a non-limiting example of the aspects of the disclosure, the user 88 selects roasted broccoli with smashed garlic to be the recipe 90 from the application 98 on the mobile device 72. The recipe 90 from the application 98 can provide ingredients 102*a* such as broccoli florets, garlic cloves, extra virgin olive oil, kosher salt, or black pepper to the mobile device 72. The user 88 can select the number of servings 102*b* to be, for example, 4 servings using the application 98. The cooking procedure 102*c* can include preheating the oven to 450 degrees Fahrenheit, baking in a dish the combined ingredients. The time of day cooked 102*d* can be detected to be 5:00 pm by the mobile device 72. The cooking duration 102*e* can be determined from the recipe 90 to be 20 minutes. The cooking duration 102*e* can be communicated to the mobile device 72 via the application 98. Additionally or alternatively, the cooking duration can be determined by the oven 78 to be 30 minutes. The deviations from the recipe 102*f* can be entered using the application 98. For example, the user 88 can select via the application 98 to add cheese to the recipe 90. The location 102*g* can be determined by direct user input or detection by the mobile device 72. The at least one input 102 can be communicated by the mobile device 72 via the router 74 to the cycle selection module 76 which can be included in the external computer system 92. The cycle selection module 76 can optionally connect to the external computer system 92. Additionally or alternatively, cycle selection module 76 can communicate with the controller 50 of the dishwasher 10 directly or using the router 74.

The at least one input 102 is received by the cycle selection module 76 via the mobile device 72, the oven 78, the dishwasher 10, the external computer system 92, cloud storage, or other member of the network 70. The at least one input 102 is used to determine the at least one parameter of the load 104. For example, the number of place settings 104*a* can be determined by the number of servings 102*b* and the cooking procedure 102*c*. For example, when the number of servings 102*b* is 4 and combined with the cooking procedure 102*c* from above, the lower rack 28 can contain 1 baking pan, 4 bowls, 4 small plates, and 4 sets of silverware. The upper rack 26 can contain 4 glasses, mixing utensils, and measuring cups. This can be considered a medium or light load.

The soil content 104*b* can be determined by the ingredient 102*a*. For example, the soil content 104*b* can include oil and vegetable scraps based on the ingredient 102*a* including extra virgin olive oil and broccoli. The soil type 104*c* can be determined by the ingredient 102*a*. The soil type 104*c* can be loose soil.

The soil adherence 104*d* can be determined by the cooking procedure 102*c* and the time of day cooked 102*d*. The soil adherence 104*d* can be a baked soil based on the cooking procedure 102*c*. Additionally, the soil adherence 104*d* can be increased if the cycle of operation is performed several hours after the time of day cooked 102*d*.

The deviations from a normal load 104*e* can be determined by the deviations from the recipe 102*f*. For example, the addition of cheese to the recipe 90.

The length of rinse 106*a* can be influenced by the number of place settings 104*a*. For example, the number of place settings 104*a* qualifying as medium or light load could result in 2 minutes of rinse time for the upper rack 26 and lower rack 28.

The output water temperature 106*b* can be influenced by the soil content 104*b*. For example, if the soil content 104*b* is considered loose, the water can be heated, by the heating element 49, for 3 minutes before reaching the output water temperature 106*b* determined by the soil content 104*b*.

The amount of treating chemistry 106*c* can be influenced by the soil content 104*b* and the soil type 104*c*. For example, an increase of 10 grams of treating chemistry can be supplied when soil content 104*b* includes extra virgin olive oil and the soil type 104*c* is loose soil.

The length of wash 106*d* can be influenced by the soil adherence 104*d* and the number of place settings 104*a*. For example, when the soil adherence is baked on and the number of place settings 104*a* is medium or light load, an additional 1 minutes can be added to the length of wash 106*d*.

The zone of wash 106*e* can be influenced by the number of place settings 104*a*. For example, when the soil adherence is baked on and the number of place settings 104*a* is medium or light load, the additional 1 minute added to the length of wash 106*d* can be added to the lower rack 28 portion of the treating cycle where the upper rack 26 does not see an increase from the standard treating time.

The deviations from the recipe 102*f* can influence the at least one cycle parameter 106. For example, if cheese is added to the recipe 90 and is input as the deviations from the recipe 102*f*, the deviations from a normal load 104*e* can use the deviations from the recipe 102*f* to increase the length of wash from an additional 1 minute (as illustrated above), to an additional 2 minutes.

The water softener 106*f* can be influenced or determined by the location 102*g*. If the user is geographically located in a region with water known to be hard water, the water softener 106*f* can be run as part of the cycle of operation.

The aspects disclosed herein provide a method and system for defining a cycle of operation for a dishwasher. The technical effect is that the above described aspects enable an automatic selection of at least one cycle parameter that define a cycle of operation for the dishwasher based on input related to a recipe.

An advantage of the aspects of the present disclosure can include automatic cycle selection based on a recipe selected by a user. The user is not required to provide additional cycle selections to define a cycle of operation, although it remains an option.

It is intended that the following concepts can define at least a portion of the scope of the disclosure and that the apparatus and/or method(s) within the scope of these concepts and their equivalents be covered thereby. This disclosure should be understood to include all novel and non-obvious combinations of elements described herein, and the concepts may be presented in this or a later application to any novel and non-obvious combination of these elements. Any aspect of any portion of this disclosure can be combined with any aspect of any of the other portions of this disclosure. Moreover, the foregoing disclosure is illustrative, and no single feature or element is essential to all possible combinations that may be included in this or a later application.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A method of operating a dishwasher, the method comprising:

automatically receiving, at a controller of the dishwasher, at least one input from an application on a mobile device, where the at least one input is related to a recipe selected by a user, and wherein upon selection of the recipe by the user at the mobile device, the at least one input is automatically transmitted from the mobile device to the controller of the dishwasher;

determining, at the controller of the dishwasher, at least one parameter of a load based on the at least one input, wherein the at least one input includes one of: an ingredient, number of servings, cooking procedure, time of day cooked, cooking duration, or deviations from the recipe;

selecting, via the controller, at least one cycle parameter based on the at least one parameter of the load to define a cycle of operation;

operating, via the controller, the dishwasher to execute the defined cycle of operation; and obtaining user feedback at the controller related to the defined cycle of operation, and repeating or selectively adjusting a future defined cycle of operation based thereon.

2. The method of claim 1 wherein the user feedback is requested by the mobile device.

3. The method of claim 1 wherein the user feedback includes determining at least one of: a satisfactory treatment, an unsatisfactory treatment, a satisfactory duration, an unsatisfactory duration, or a grade of utensils.

4. The method of claim 3 wherein when duration is determined to be unsatisfactory the at least one cycle parameter adjustment includes at least one of water temperature is increased, treating chemistry amount is increased, spray pressure is increased.

5. The method of claim 1 wherein adjusting a future cycle of operation includes changing one or more of: length of rinse, output water temperature, amount of treating chemistry, length of wash, or zone of wash.

6. The method of claim 1 wherein the obtained user feedback is a satisfaction or dissatisfaction of one or more of: an executed cycle of operation, a duration of an executed cycle, a washing portion of an executed cycle of operation, a drying portion of an executed cycle of operation, a level of noise during an executed cycle of operation, or an environmental aspect of an executed cycle of operation.

7. The method of claim 6 wherein when the washing portion of the executed cycle of operation is determined to be unsatisfactory the at least one cycle parameter adjustment includes obtaining additional user feedback indicating whether an upper rack or a lower rack of the dishwasher was washed at an unsatisfactory level.

8. The method of claim 6 wherein when the level of noise during the executed cycle of operation is determined to be unsatisfactory the at least one cycle parameter adjustment includes setting one or more components of a pump assembly to operate at a lower power.

9. The method of claim 6 wherein when the environmental aspect of the executed cycle of operation is determined to be unsatisfactory the at least one cycle parameter adjustment includes updating the at least one cycle parameter to use less water or energy.

10. The method of claim 1 wherein the user feedback further includes a grade of utensils following the cycle of operation.

11. The method of claim 1 wherein the obtained user feedback further comprises providing a communication alert based the obtained user feedback.

12. The method of claim 11 wherein the communication alert is provided to the mobile device or an external computer.

13. The method of claim 12 wherein the communication alert provided to the mobile device or the external computer is indicative of a possible need for servicing the dishwasher.

14. The method of claim 1 wherein the automatically receiving the at least one input includes receiving on the mobile device at least one of: an image of a recipe, a barcode scan of a recipe, a barcode scan of at least one ingredient, an ISBN and page number of a recipe book.

15. The method of claim 1 wherein the automatically receiving the at least one input includes receiving a recipe selection from a recipe database and wherein the recipe database is searchable by at least one user via the mobile device.

16. The method of claim 1 wherein the at least one parameter of the load is at least one of: number of place settings, soil content, soil type, soil adherence, deviations from a normal load, or deviations from the recipe.

17. The method of claim 16 wherein the at least one cycle parameter includes at least two of: length of rinse, output water temperature, amount of treating chemistry, length of wash, or zone of wash.

18. The method of claim 1, further comprising determining regional water features and further selecting the at least one cycle parameter including at least one of: water temperature or water softening based thereon.

* * * * *